US007002445B2

(12) United States Patent
Hall et al.

(10) Patent No.: US 7,002,445 B2
(45) **Date of Patent: *Feb. 21, 2006**

(54) LOADED TRANSDUCER FOR DOWNHOLE DRILLING COMPONENTS

(75) Inventors: David R. Hall, Provo, UT (US); H. Tracy Hall, Jr., Provo, UT (US); David S. Pixton, Lehi, UT (US); Michael A. Briscoe, Lehi, UT (US); Scott Steven Dahlgren, Alpine, UT (US); Joe Fox, Spanish Fork, UT (US); Cameron Sneddon, Lombard, IL (US)

(73) Assignee: IntelliServ, Inc., Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/908,249

(22) Filed: May 4, 2005

(65) Prior Publication Data

US 2005/0236160 A1 Oct. 27, 2005

Related U.S. Application Data

(62) Division of application No. 10/430,734, filed on May 6, 2003, now Pat. No. 6,913,093.

(51) Int. Cl.
*H01F 21/06* (2006.01)

(52) U.S. Cl. ..... 336/132; 166/242.6; 340/854.3; 439/191

(58) Field of Classification Search ..... 340/854.3; 439/190–194; 336/84 R, 84 C, 84 M, 130–135; 166/242.6; 175/57
See application file for complete search history.

(56) References Cited

U.S. PATENT DOCUMENTS

| | | | | |
|---|---|---|---|---|
| 3,696,332 A * | 10/1972 | Dickson et al. | 340/855.1 |
| 4,095,865 A * | 6/1978 | Denison et al. | 439/191 |
| 4,605,268 A * | 8/1986 | Meador | 439/194 |
| 4,914,433 A * | 4/1990 | Galle | 340/854.4 |
| 6,123,561 A * | 9/2000 | Turner et al. | 439/194 |
| 6,688,396 B1 * | 2/2004 | Floerke et al. | 166/380 |
| 6,929,493 B1 * | 8/2005 | Hall et al. | 439/191 |

* cited by examiner

*Primary Examiner*—Timothy Edwards, Jr.
(74) *Attorney, Agent, or Firm*—Jeffery E. Daly

(57) ABSTRACT

A robust transmission element for transmitting information between downhole tools, such as sections of drill pipe, in the presence of hostile environmental conditions, such as heat, dirt, rocks, mud, fluids, lubricants, and the like. The transmission element maintains reliable connectivity between transmission elements, thereby providing an uninterrupted flow of information between drill string components. A transmission element is mounted within a recess proximate a mating surface of a downhole drilling component, such as a section of drill pipe. To close gaps present between transmission elements, transmission elements may be biased with a "spring force," urging them closer together.

15 Claims, 4 Drawing Sheets

LOADED TRANSDUCER FOR DOWNHOLE DRILLING COMPONENTS

CROSS REFERENCE TO RELATED APPLICATIONS

This application is a Division of pending U.S. patent application Ser. No. 10/430,734 "Loaded Transducer for Downhole Drilling Components" filed on May 6, 2003 now U.S. Pat. No. 6,913,093, by David R. Hall, et al, and incorporated by reference herein for all it discloses.

STATEMENT OF GOVERNMENT INTEREST

This invention was made with government support under Contract No. DE-FC26-01NT41229 awarded by the U.S. Department of Energy. The government has certain rights in the invention.

BACKGROUND OF THE INVENTION

1. The Field of the Invention

This invention relates to oil and gas drilling, and more particularly to apparatus and methods for reliably transmitting information between downhole drilling components.

2. The Relevant Art

For the past several decades, engineers have worked to develop apparatus and methods to effectively transmit information from components located downhole on oil and gas drilling strings to the ground's surface. Part of the difficulty of this problem lies in the development of reliable apparatus and methods for transmitting information from one drill string component to another, such as between sections of drill pipe. The goal is to provide reliable information transmission between downhole components stretching thousands of feet beneath the earth's surface, while withstanding hostile wear and tear of subterranean conditions.

In an effort to provide solutions to this problem, engineers have developed a technology known as mud pulse telemetry. Rather than using electrical connections, mud pulse telemetry transmits information in the form of pressure pulses through fluids circulating through a well bore. However, data rates of mud pulse telemetry are very slow compared to data bandwidths needed to provide real-time data from downhole components.

For example, mud pulse telemetry systems often operate at data rates less than 10 bits per second. At this rate, data resolution is so poor that a driller is unable to make crucial decisions in real time. Since drilling equipment is often rented and very expensive, even slight mistakes incur substantial expense. Part of the expense can be attributed to time-consuming operations that are required to retrieve downhole data or to verify low-resolution data transmitted to the surface by mud pulse telemetry. Often, drilling or other procedures are halted while crucial data is gathered.

In an effort to overcome limitations imposed by mud pulse telemetry systems, reliable connections are needed to transmit information between components in a drill string. For example, since direct electrical connections between drill string components may be impractical and unreliable, converting electrical signals to magnetic fields for later conversion back to electrical signals offers one solution for transmitting information between drill string components.

Nevertheless, various factors or problems may make data transmission unreliable. For example, dirt, rocks, mud, fluids, or other substances present when drilling may interfere with signals transmitted between components in a drill string. In other instances, gaps present between mating surfaces of drill string components may adversely affect the transmission of data therebetween.

Moreover, the harsh working environment of drill string components may cause damage to data transmission elements. Furthermore, since many drill string components are located beneath the surface of the ground, replacing or servicing data transmission components may be costly, impractical, or impossible. Thus, robust and environmentally-hardened data transmission components are needed to transmit information between drill string components.

SUMMARY OF THE INVENTION

In view of the foregoing, it is a primary object of the present invention to provide robust transmission elements for transmitting information between downhole tools, such as sections of drill pipe, in the presence of hostile environmental conditions, such as heat, dirt, rocks, mud, fluids, lubricants, and the like. It is a further object of the invention to maintain reliable connectivity between transmission elements to provide an uninterrupted flow of information between drill string components.

Consistent with the foregoing objects, and in accordance with the invention as embodied and broadly described herein, an apparatus is disclosed in one embodiment of the present invention as including a transmission element having a communicating surface mountable proximate a mating surface of a downhole drilling component, such as a section of drill pipe.

By "mating surface," it is meant a surface on a downhole component intended to contact or nearly contact the surface of another downhole component, such as another section of drill pipe. For example, a mating surface may include threaded regions of a box end or pin end of drill pipe, primary or secondary shoulders designed to come into contact with one another, or other surfaces of downhole components that are intended to contact or come into close proximity to surfaces of other downhole components.

A transmission element may be configured to communicate with a corresponding transmission element located on another downhole component. The corresponding transmission element may likewise be mountable proximate a mating surface of the corresponding downhole component. In order to close gaps present between communicating surfaces of transmission elements, transmission elements may be biased with respect to the mating surfaces they are mounted on.

By "biased," it is meant, for the purposes of this specification, that a transmission element is urged, by a biasing member, such as a spring or an elastomeric material, or by a "spring force" caused by contact between a transmission element and a mating surface, in a direction substantially orthogonal to the mating surface. Thus, the term "biased" is not intended to denote a physical position of a transmission element with respect to a mating surface, but rather the condition of a transmission element being urged in a selected direction with respect to the mating surface. In selected embodiments, the transmission element may be positioned flush with, above, or below the mating surface.

Since a transmission element is intended to communicate with another transmission element mounted to another downhole tool, in selected embodiments, only a single transmission element is biased with respect to a mating surface. For example, transmission elements may be biased only in "pin ends" of downhole tools, but may be unbiased or fixed in "box ends" of the same downhole tools. However, in other embodiments, the transmission elements are biased in both the pin ends and box ends.

In selected embodiments, a gap may be present between mating surfaces of downhole tools due to variations in tolerances, or materials that may become interposed between the mating surfaces. In other embodiments, the mating surfaces are in contact with one another. In selected embodiments, a biasing member, such as a spring or elastomeric material may be inserted between a transmission element and a corresponding mating surface to effect a bias therebetween.

A mating surface may be shaped to include a recess. A transmission element may be mounted or housed within the recess. In selected embodiments, a recess may include a locking mechanism to retain the transmission element within the recess. In certain embodiments, the locking mechanism is a locking shoulder shaped into the recess. A transmission element, once inserted into the recess, may slip past and be retained by the locking shoulder.

A transmission element and corresponding recess may have an annular shape. In selected embodiments, a transmission element may snap into the recess and be retained by the locking mechanism. In selected embodiments, angled surfaces of the recess and the transmission element may create a "spring force" urging the transmission element in a direction substantially orthogonal to the mating surface. This "spring force" may be caused by the contact of various surfaces of the transmission element and the recess, including the outside diameters, the inside diameters, or a combination thereof.

In selected embodiments, a transmission element on a downhole component communicates with a transmission element on a separate downhole component by converting an electrical signal to a magnetic field or current. The magnetic field or current induces an electrical current in a corresponding transmission element, thereby recreating the original electrical signal. In other embodiments, a transmission element located on a downhole component may communicate with a transmission element on another downhole component due to direct electrical contact therebetween.

In another aspect of the present invention, a method for transmitting information between downhole tools located on a drill string includes mounting a transmission element, having a communicating surface, proximate a mating surface of a downhole tool. Another transmission element, having a communicating surface, may be mounted proximate a mating surface of another downhole tool, the mating surfaces of each downhole tool being configured to contact one another. The method may further include biasing at least one transmission element with respect to a corresponding mating surface to close gaps present between communicating surfaces of the transmission elements.

In certain instances, a gap may be present between the mating surfaces. In other instances, mating surfaces may be in direct contact with one another. The method may further include providing a biasing member, such as a spring, elastomeric material, or the like, to effect the bias between a transmission element and a mating surface.

A method may further include shaping a mating surface to include a recess such that the transmission element substantially resides in the recess. Within the recess, a locking mechanism may be provided to retain the transmission element within the recess. The locking mechanism may be a locking shoulder and the transmission element may be retained within the first recess by slipping by and engaging the locking shoulder.

A method in accordance with the invention may further include forming a transmission element and a recess into an annular shape. Furthermore, biasing of the transmission element may be provided by angled surfaces of the recess and the transmission element to create a "spring force," thereby urging the transmission element in a direction substantially orthogonal to a mating surface. This "spring force" may be caused by contact between various surfaces of the transmission element and the recess, including the outside diameters, the inside diameters, or a combination thereof. The method may further include communicating between transmission elements due to direct electrical contact or by transfer of magnetic energy therebetween.

In another aspect of the present invention, an apparatus for transmitting data between downhole tools may include a loaded annular housing. By "loaded," it is meant, for the purposes of this specification, providing a "spring force" between a mating surface and an annular housing mounted thereon. In selected embodiments, the annular housing may include at least one substantially U-shaped element disposed within the loaded annular housing.

The U-shaped element may be composed of a magnetically conductive and electrically insulating material, such as ferrite, thereby enabling magnetic current to be retained therein and channeled in a desired direction. An electrical conductor may be disposed within the U-shaped element to carry electrical current. The electrical conductor may be electrically insulated to prevent shorting of the conductor to other electrically conductive components.

The loaded annular housing may be formed such that it is mountable in a recess of a mating surface of a downhole tool. The annular housing may be flush with the mating surface, below the mating surface, above the mating surface, or a combination thereof.

BRIEF DESCRIPTION OF THE DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
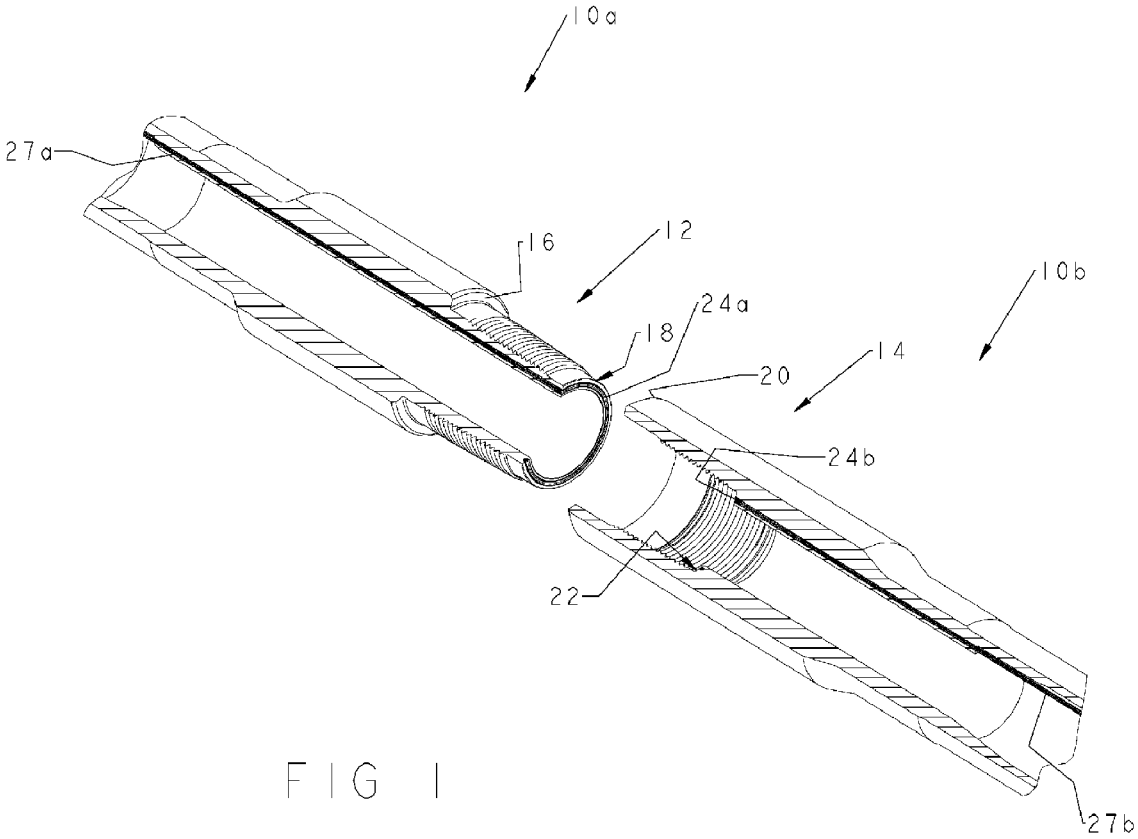
FIG. 1 is a perspective view illustrating one embodiment of sections of downhole drilling pipe using transmission elements, in accordance with the invention, to transmit and receive information along a drill string.

Referring to FIG. 1, drill pipes 10*a*, 10*b*, or other downhole tools 10*a*, 10*b*, may include a pin end 12 and a box end 14 to connect drill pipes 10*a*, 10*b* or other components 10*a*, 10*b* together. In certain embodiments, a pin end 12 may include an external threaded portion to engage an internal threaded portion of the box end 14. When threading a pin end 12 into a corresponding box end 14, various shoulders may engage one another to provide structural support to components connected in a drill string.

For example, a pin end 12 may include a primary shoulder 16 and a secondary shoulder 18. Likewise, the box end 14 may include a corresponding primary shoulder 20 and secondary shoulder 22. A primary shoulder 16, 20 may be labeled as such to indicate that a primary shoulder 16, 20 provides the majority of the structural support to a drill pipe 10 or downhole component 10. Nevertheless, a secondary shoulder 18 may also engage a corresponding secondary shoulder 22 in the box end 14, providing additional support or strength to drill pipes 10 or components 10 connected in series.

As was previously discussed, apparatus and methods are needed to transmit information along a string of connected drill pipes 10 or other components 10. As such, one major issue is the transmission of information across joints where a pin end 12 connects to a box end 14. In selected embodiments, a transmission element 24*a* may be mounted proximate a mating surface 18 or shoulder 18 on a pin end 12 to communicate information to another transmission element 24*b* located on a mating surface 22 or shoulder 22 of the box end 14. Cables 27*a*, 27*b*, or other transmission medium 27, may be operably connected to the transmission elements 24*a*, 24*b* to transmit information therefrom along components 10*a*, 10*b*.

In certain embodiments, a recess may be provided in the secondary shoulder 18 of the pin end 12 and in the secondary shoulder 22 of the box end 14 to house each of the transmission elements 24*a*, 24*b*. The transmission elements 24*a*, 24*b* may have an annular shape and be mounted around the radius of the drill pipe 10. Since a secondary shoulder 18 may contact or come very close to a secondary shoulder 22 of a box end 14, a transmission element 24*a* may sit substantially flush with a secondary shoulder 18 on a pin end 12. Likewise, a transmission element 24*b* may sit substantially flush with a surface of a secondary shoulder 22 of a box end 14.

In selected embodiments, a transmission element 24*a* may communicate with a corresponding transmission element 24*b* by direct electrical contact therewith. In other embodiments, the transmission element 24*a* may convert an electrical signal to a magnetic flux or magnetic current. A corresponding transmission element 24*b*, located proximate the transmission element 24*a*, may detect the magnetic field or current. The magnetic field may induce an electrical current into the transmission element 24*b* that may then be transmitted from the transmission element 24*b* to the electrical cable 27*b* located along the drill pipe 10 or downhole component 10.

As was previously stated, a downhole drilling environment may adversely affect communication between transmission elements 24*a*, 24*b* located on successive drill string components 10. For example, materials such as dirt, mud, rocks, lubricants, or other fluids, may inadvertently interfere with the contact or communication between transmission elements 24*a*, 24*b*. In other embodiments, gaps present between a secondary shoulder 18 on a pin end 12 and a secondary shoulder 22 on a box end 14 due to variations in component tolerances may interfere with communication between transmission elements 24*a*, 24*b*. Thus, apparatus and methods are needed to reliably overcome these as well as other obstacles.

Figure 2:
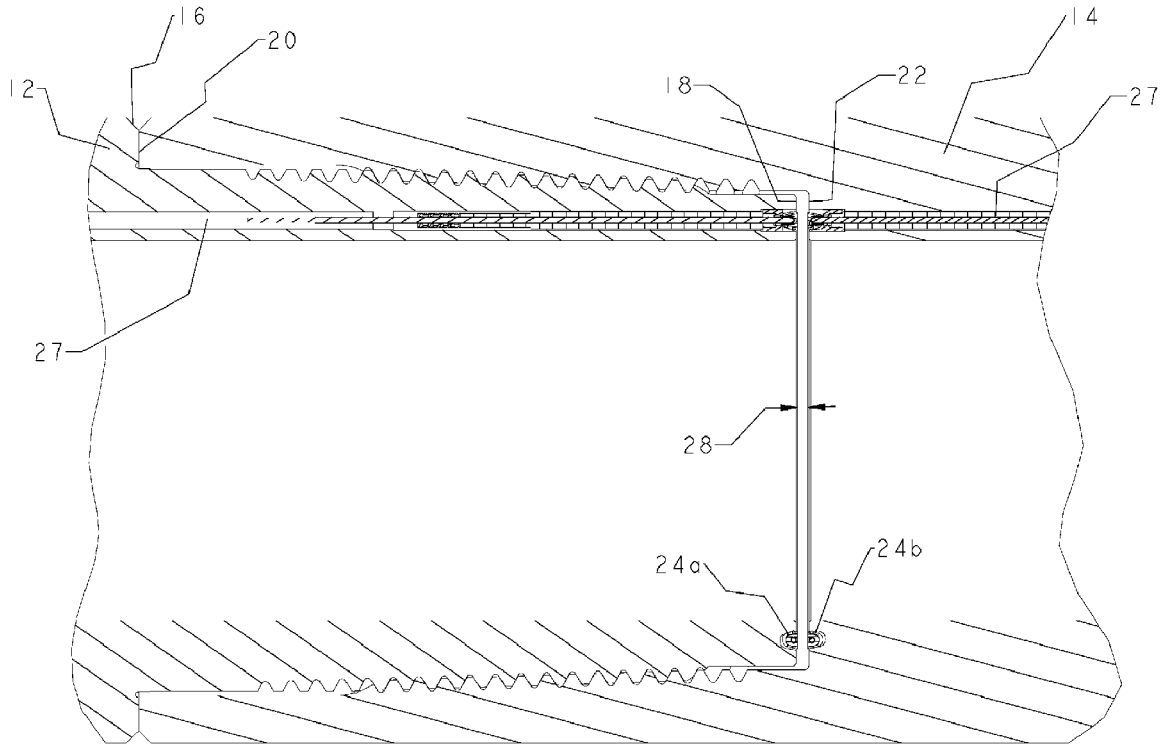
FIG. 2 is a cross-sectional view illustrating one embodiment of gaps that may be present between a pin end and box end of downhole drilling components, thereby causing unreliable communication between transmission elements.

Referring to FIG. 2, for example, as was previously stated, a gap 28 may be present between the secondary shoulders 18, 22 of the pin end 12 and box end 14. This gap 28 may be the result of variations in manufacturing tolerances between different sections 10*a*, 10*b* of pipe. In other embodiments, the gap 28 may be the result of materials such as dirt, rocks, mud, lubricants, fluids, or the like, interposed between the shoulders 18, 22.

If transmission elements 24*a*, 24*b* are designed for optimal function when in direct contact with one another, or when in close proximity to one another, materials or variations in tolerances leaving a gap 28 may cause malfunction of the transmission elements 24*a*, 24*b*, impeding or interfering with the flow of data. Thus, apparatus and methods are needed to improve reliability of communication between transmission elements 24*a*, 24*b* even in the presence of gaps 28 or other interfering substances.

In accordance with the present invention, a transmission element 24*a*, 24*b* may be provided such that it is moveable with respect to a corresponding shoulder 18, 22. Thus, transmission elements 24*a*, 24*b* may be translated such that they are in closer proximity to one another to enable effective communication therebetween. In selected embodiments, direct contact between transmission elements 24*a*, 24*b* may be required.

In other embodiments, only a specified separation may be allowed between transmission elements 24*a*, 24*b* for effective communication. As illustrated, transmission elements 24*a*, 24*b* may be mounted in secondary shoulders 18, 22 of the pin end 12 and box end 14 respectively. In reality, the transmission elements 24*a*, 24*b* may be provided in any suitable surface of the pin end 12 and box end 14, such as in primary shoulders 16, 20.

Figure 3:
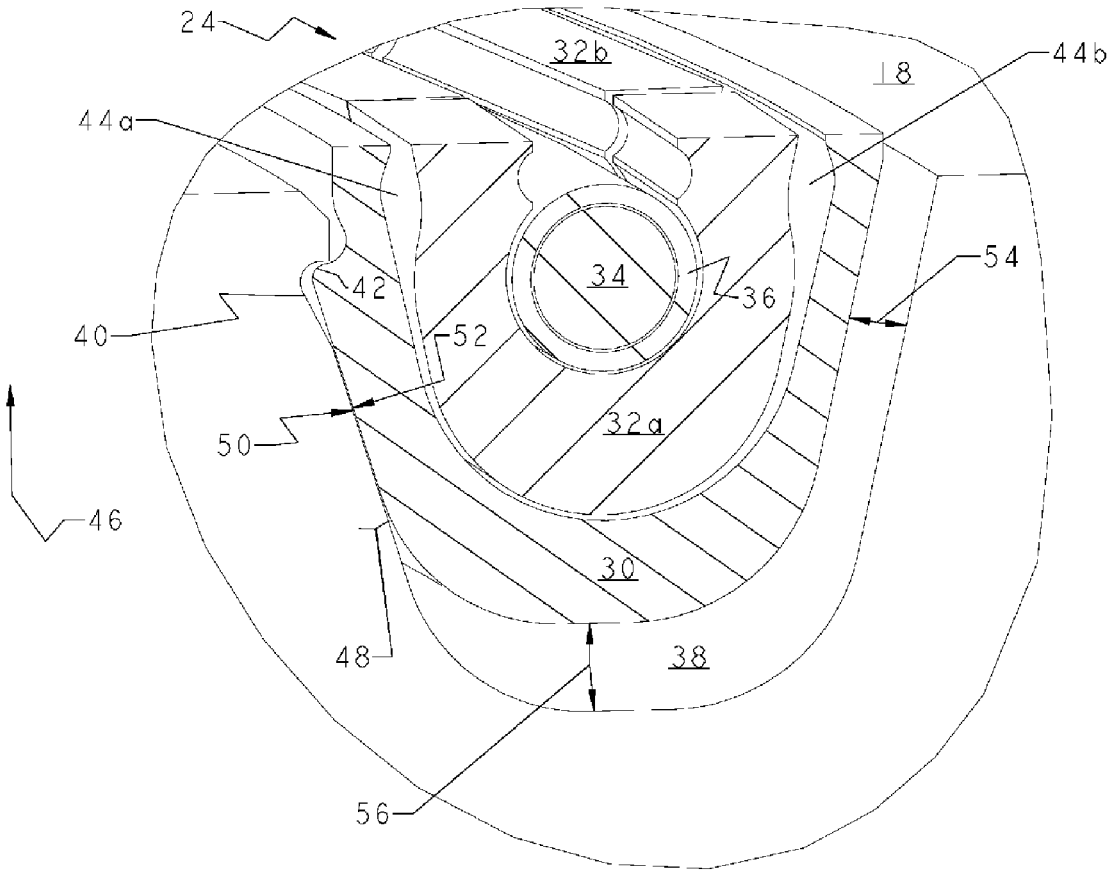
FIG. 3 is a perspective cross-sectional view illustrating one embodiment of an improved transmission element retained within a recess of a box end or pin end of a downhole drilling component.

Referring to FIG. 3, in selected embodiments, a transmission element 24 may include an annular housing 30. The annular housing 30 may include a magnetically conducting electrically insulating element 32 therein, such as ferrite or some other material of similar electrical and magnetic properties. The element 32*a* may be formed in a U-shape and fit within the housing 30. Within the U-shaped element 32*a*, a conductor 34 may be provided to carry electrical current therethrough. In selected embodiments, the electrical conductor 34 is coated with an electrically insulating material 36.

As current flows through the conductor 34, a magnetic flux or field may be created around the conductor 34. The U-shaped element 32 may serve to contain the magnetic flux created by the conductor 34 and prevent energy leakage into surrounding materials. The U-shape of the element 32 may also serve to transfer magnetic current to a similarly shaped element 32 in another transmission element 24. Since materials such as ferrite may be quite brittle, the U-shaped elements 32 may be provided in segments 32*a*, 32*b* to prevent cracking or breakage that might otherwise occur using a single piece of ferrite.

As was previously stated, a recess 38 may be provided in a mating surface 18, such as in a secondary shoulder 18. Likewise, the transmission element 24 may be inserted into and retained within the recess 38. In selected embodiments, the recess 38 may include a locking mechanism to enable the housing 30 to enter the recess 38 while preventing the exit therefrom. For example, in one embodiment, a locking mechanism may simply be a groove 40 or recess 40 formed within the larger recess 38. A corresponding shoulder 42 may be formed in the housing 30 such that the shoulder 42 engages the recess 40, thereby preventing the housing 30 from exiting the larger recess 38.

As was previously discussed, in order to close gaps 28 or space 28 present between transmission elements 24*a*, 24*b*, in the pin end 12 and box end 14, respectively, a transmission element 24 may be biased with respect to a mating surface 18, such as a secondary shoulder 18. That is, a transmission element 24 may be urged in a direction 46 with respect to a secondary shoulder 18. In selected embodiments, angled surfaces 50, 52 of the recess 38 and housing 30, respectively, may provide this "spring force" in the direction 46.

For example, each of the surfaces 50, 52 may form an angle 48 with respect to a direction normal or perpendicular to the surface 18. This angle 48 may urge the housing 30 in a direction 46 due to its slope 48. That is, if the housing 30 is in tension as it is pressed into the recess 38, a spring-like force may urge the housing 30 in a direction 46.

In other embodiments, a biasing member, such as a spring or other elastomeric material may be inserted between the housing 30 and the recess 38, in a space 56, to urge the housing 30 in a direction 46. In selected embodiments, the housing 30 may only contact a single surface 50 of the recess 38. Gaps 54, 56 may be present between the recess 38 and the housing 30 along other surfaces. These may serve several purposes.

For example, if the housing 30 were to contact both a surface 50 on one side of the recess 38, as well as another surface 54 on the other side of the recess 38, pressure on both sides of the housing 30 may create undesired stress on a U-shaped element 32 or elements 32*a*, 32*b*. If an element 32 is constructed of ferrite, the stress may cause cracking or damage due to its brittleness. Thus, in selected embodiments, it may be desirable that only a single surface 50 of the housing 30 contact a surface 52 of the recess 38.

Nevertheless, a surface 50 in contact with the housing 38 may be along either an inside or outside diameter of the recess 38, or a combination thereof. Other recesses 44*a*, 44*b*, or spaces 44*a*, 44*b*, may be provided between the housing 30 and U-shaped elements 32. These recesses 44*a*, 44*b* may be filled with an elastomeric or bonding material to help retain the U-shaped elements 32 within the housing 30.

Figure 4C:
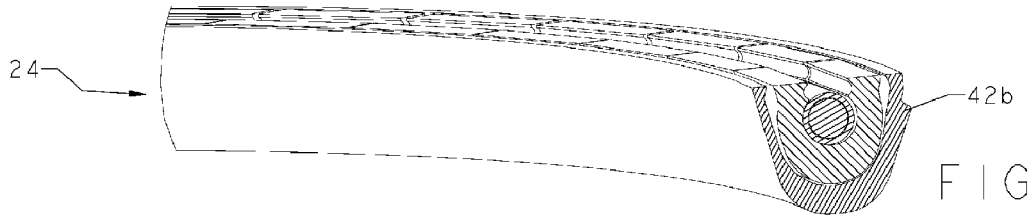
FIG. 4C is a perspective cross-sectional view illustrating one embodiment of a shoulder formed along the outside diameter of a loaded annular transmission element.
Figure 4B:
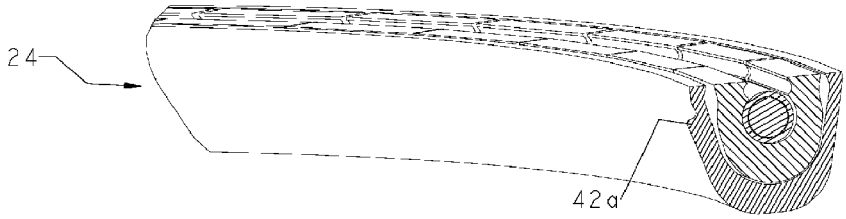
FIG. 4B is a perspective cross-sectional view illustrating one embodiment of a shoulder formed along the inside diameter of a loaded annular transmission element.
Figure 4A:
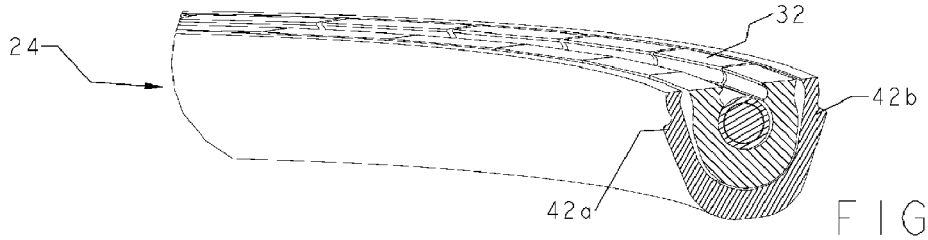
FIG. 4A is a perspective cross-sectional view illustrating one embodiment of a shoulder formed along both the inside and outside diameters of a loaded annular transmission element.

Referring to FIGS. 4A, 4B, and 4C, while continuing to refer generally to FIG. 3, a transmission element 24 may include one or several shoulders 42 to engage one or several locking recesses 40 within the larger recess 38. For example, referring to FIG. 4A, a transmission element 24 may include multiple locking shoulders 42*a*, 42*b* along both an inner and outer diameter of a housing 30. These shoulders 42*a*, 42*b* may interlock with corresponding grooves 40 or recesses 40 formed in the recess 38.

In another embodiment, referring to FIG. 4B, a transmission element 24 may simply include a single locking shoulder 42*a* located along an inside diameter of the transmission element 24. This locking shoulder 42*a* may engage a corresponding groove 40 or recess 40 located along the inside diameter of the larger recess 38. Likewise, with respect to FIG. 4C, a transmission element 24 may simply include a locking shoulder around an outside diameter of the transmission element 24. A corresponding groove 40 may be included around the outside diameter of the recess 38 to retain the transmission element 24.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. An apparatus for transmitting data between downhole tools, the apparatus comprising:

an annular housing having an angled surface interacting with a recess in one of the downhole tools and exerting a spring force to load the annular housing;

at least one substantially U-shaped element disposed within the loaded annular housing, wherein the U-shaped element is magnetically conductive and electrically insulating; and at least one electrical conductor disposed within the at least one U-shaped element.

2. The apparatus of claim 1, wherein the electrical conductor is electrically insulated.

3. The apparatus of claim 1, wherein:

the recess is formed to include a locking shoulder; and the annular housing is retained by the locking shoulder.

4. The apparatus of claim 1, wherein the recess is formed in a mating surface of the one of the downhole tools, and the annular housing is mountable in the recess.

5. The apparatus of claim 4, wherein the annular housing is mountable at a position selected from the group consisting of flush with the mating surface, below the mating surface, and above the mating surface.

6. The apparatus of claim 4, wherein:

the recess has an annular shape; and the annular housing is biased with respect to the mating surface due to tension between surfaces of the annular housing and the recess.

7. The apparatus of claim 6, wherein the tension between surfaces of the annular housing and the recess are due to tension along at least one of an outside diameter, an inside diameter, and a combination thereof, of the annular housing and recess.

8. The apparatus of claim 4, further comprising a first communications surface on the annular housing, wherein the annular housing is biased with respect to the mating surface;

a second one of the downhole tools having a second loaded annular housing with a second communications surface configured to substantially communicate with the first communications surface.

9. The apparatus of claim 8, wherein the communications surfaces communicate with each other due to direct electrical contact therebetween.

10. The apparatus of claim 8, wherein the communications surfaces communicate with each other by the transfer of magnetic energy therebetween.

11. The apparatus of claim 8, wherein:

the annular housing is substantially residing in the recess; and a second mating surface on the second one of the downhole tools is shaped to include a second recess, the second loaded annular housing substantially residing in the second recess.

12. The apparatus of claim 11, wherein the second loaded annular housing is biased with respect to the second mating surface to close gaps present between the first and second communicating surfaces when the respective downhole tools are joined.

13. The apparatus of claim 12, wherein a gap is present between the mating surfaces.

14. The apparatus of claim 12, wherein the mating surfaces are in contact with one another.

15. The apparatus of claim 12, further comprising a second biasing member to effect the bias between the second loaded annular housing and the second mating surface.

* * * * *